United States Patent [19]

Tamaro

[11] 4,055,927

[45] Nov. 1, 1977

[54] CONCRETE WALLS AND REINFORCEMENT CAGE THEREFOR

[75] Inventor: George John Tamaro, Leonia, N.J.

[73] Assignee: COS Corporation of America, New York, N.Y.

[21] Appl. No.: 701,777

[22] Filed: July 2, 1976

Related U.S. Application Data

[62] Division of Ser. No. 603,982, Aug. 12, 1975, Pat. No. 4,005,582.

[51] Int. Cl.[2] ..... E04G 21/12

[52] U.S. Cl. ..... 52/577; 52/602; 52/742; 61/49; 264/35

[58] Field of Search ..... 52/600, 601, 602, 576, 52/577, 323, 338, 339, 320, 321, 322, 324, 326, 742; 61/49, 53.62, 50.35; 264/35

[56] References Cited

U.S. PATENT DOCUMENTS

| | | | |
|---|---|---|---|
| 610,139 | 8/1898 | Jenkins | 52/339 |
| 662,634 | 11/1900 | White | 52/321 |
| 693,429 | 2/1902 | Orr | 52/326 |
| 834,940 | 11/1906 | Sherwood | 249/23 |
| 1,776,999 | 9/1930 | Jensen | 52/316 |
| 2,083,987 | 6/1937 | Davis | 52/601 |
| 2,151,148 | 3/1939 | Plumb | 52/601 |
| 2,969,619 | 1/1961 | Didrick | 52/601 |
| 3,381,483 | 5/1968 | Huthsing | 52/601 |
| 3,412,562 | 11/1968 | Doughty | 61/49 |
| 3,555,830 | 1/1971 | York | 61/49 |
| 3,604,174 | 9/1971 | Nelson | 52/601 |

FOREIGN PATENT DOCUMENTS

| | | | |
|---|---|---|---|
| 907,912 | 3/1946 | France | 52/601 |

*Primary Examiner*—Price C. Faw, Jr.
*Assistant Examiner*—Henry Raduazo
*Attorney, Agent, or Firm*—Jim Zegeer

[57] ABSTRACT

There is disclosed an improved method of constructing an underground reinforced concrete wall utilizing the slurry trench excavation method. According to the invention, at least a pair of spaced elongated primary excavations each adapted to receive a pair of H-beams rigidly joined together by steel lattice work; and a rebar cage. The channel or space in each H-beam at the outer channel between the flange and webs is filled with a polystyrene foam attached to the cage by steel plates and angles. These elements are lowered into the primary excavations and concrete is poured therein filling the spaces in the excavations and displacing any bentonite slurry from the trench to form primary wall elements. Thereafter, intermediate excavations are performed between the concreted sections and the H-beam portions thereof, the polystyrene foam being easily removed from the outer channel and the H-beam channel with the flanges thereof serving as guide elements for the excavating tool. According to a preferred procedure, the spaces between the first two primary wall panels have a length at least equal to a multiple greater than one of the primary wall panel excavations for secondary wall elements to be formed in the intermediate space. In this way, the same excavating tool can be used for forming equally spaced elements and the excavating tool will not in any way be impeded by engagement with steel H-beams since at least one end of the tool will be free to bite into earth or the space of an adjacent excavation. In order to form a reinforced excavation around and below underground utilities, and other obstructions, the earth between the two previous excavations is excavated, two beams are placed on either side of the utility or obstruction and the intervening excavation panel is cast with concrete without the use of a reinforcing cage or is cast using a steel fiber reinforced concrete in place of the reinforcing, is inserted to thereby form a reinforced wall in combination with the H-beam. There is also disclosed a novel method and apparatus for reducing wall thickness and decorating and improving surface finish of cast-in-situ underground concrete walls.

3 Claims, 8 Drawing Figures

CONCRETE WALLS AND REINFORCEMENT CAGE THEREFOR

This is a division of application Ser. No. 603,982, filed Aug. 12, 1975 now U.S. Pat. No. 4,005,582.

The present invention relates to an improved method for constructing a reinforced concrete wall in the ground utilizing a fluid substance or slurry such as bentonite, driller's mud, etc. for retaining the walls of an excavation open during the excavation. This technique has been widely used in the past and is disclosed in detail in Brunner British Pat. Nos. 913,527 and 913,528, in Veder U.S. Pat. No. 3,310,952 and Miotti U.S. Pat. No. 3,139,729 all assigned to a company related to the assignee hereof, and incorporated herein by reference. In the Miotti patent, pairs of reinforced concrete elements are set along the line of the wall and the space between the reinforced concrete elements is excavated using special tools for excavating up close to and scraping the previously cast concrete elements so as to form generally rectangular excavation elements elongated along the length of the wall. Such walls may be excavated down to great depths utilizing as guide elements the previously cast concrete elements. In accordance with the Brunner and Veder patents, a concrete curb or guide is cast along the line of the wall and a deep trench is dug as the excavation is maintained open by circulation in the excavation of a bentonite solution. Reinforcements may be then lowered into the trench and an interlocking pipe is installed in the trench at least at one end thereof. The trench is then filled with concrete from the bottom (using the tremie concreting method) forming an underground reinforced concrete wall. The interlocking pipe is removed when the concrete in the first trench has hardened or set to an extent as to be self-sustaining in its shape. This forms the key or locking element with respect to the next element. Subsequent to the depositing of the concrete, a second hole or trench is excavated in an adjacent relation to the first trench. A variation on the above-described techniques has been developed in the United States, where the first excavations are cylindrical excavations into which are placed H-beams which have a web portion transverse to the line of the trench and flange portions which are parallel generally to the line of the trench. These cylindrical excavations are then filled with a cementitious material which is just sufficient to maintain the H-beam in a vertical position. Then, between two succeeding H-beams the earth material is excavated in elongated trench sections up to and including the scraping of the not-so-hard cementitious material from the H-beam surfaces facing each other. These sections then may have steel reinforcement cages lowered thereinto and filled with concrete. The main deficiency of the method is the difficulty of maintaining verticality and therefore plan position of each beam.

THE PRESENT INVENTION

The present invention is an improvement on these techniques. In accordance with this invention, I or H-beam pairs are welded together utilizing a light weight steel lattice work and reinforcement cage or rebar cage. This consists of two steel H-beams and the cage which are preferably prefabricated at the site and tied together with steel lattice work. The two outward channels in the H-beam are filled above ground with non-cementitious excavatable materials such as rigid block polystyrene foam to eliminate the need of end pipe joints or other time consuming and expensive procedures, such as the low strength cementitious material used heretofore in effort to position the H-beam. This aspect of the invention is disclosed in an article appearing in October, 1973 issue of *Roads and Streets* magazine entitled "Slurry Wall, Special Equipment Solve 'No Room' Excavation Problem" which is incorporated herein by reference.*

*The foam system disclosed in the *Roads and Streets* article, invented by the applicant herein is deemed to be a part of the prior art insofar as the present invention is concerned.

Such H-beam pairs are lowered into the trench and in the first of said structures the primary structural framework of H-beam pairs is used as a reaming tool. For this purpose, the lower edges may be sharpened by a grinder, files or a cutting torch. This tool squares off and evens out the excavation prior to the installation of the permanent steel framework constituted by another pair of H-beams joined together by a rebar cage but of a somewhat lighter weight metal than the reaming tool. The reaming tool may be used as the concrete reinforcement and H-beam pair in the last panel section to be formed.

Intermediate panels are excavated between the two previously poured primary panels and steel cages are inserted in them. The intermediate panels are then back filled with concrete as heretofore.

In some cases, underground structures such as utilities, telephones, etc. may be met. In whichcase, typically in the past these utilities have either been rerouted or such sections have simply been excavated around the utility and filled with concrete and not reinforced. According to a further aspect of the present invention, the existing utilities are excavated around as before, and then the excavation is filled with a conventional concrete or a steel fiber reinforced concrete. This permits the lateral bending strength of the H-beams to be joined with concrete or the fiber steel reinforcement to provide an underground reinforced concrete wall where such obstructions have been met which has a strength approaching that at least of the conventional steel reinforced concrete walls for equivalent lengths.

In addition, interior facing walls may have special block out sections provided which lead to making thinner walls in situ from walls having highly decorative effects, and walls wherein the amount of reinforcement can be effectively utilized.

The special advantages of the present invention are as follows:

1. The H-beam and concrete lagging system is installed without the need of pre-drilling and pre-setting of H-beams prior to removing the soil between the beams,
2. Excellent watertignections between the panels is assured by the use of steel beams as a water stop. Styrofoam block outs inserted between the flanges of the beams at the ends eliminates the need of "end-joint" pipes or other time consuming and expensive construction procedures, permits the easy cleanin g of the joint and assures a structually sound, clean, watertight joint,
3. Excellent vertical and horizontal alignment of the rigid H-beam framework is assured by the steel lattice work. This rigorous control of the structural elements of the slurry wall assures a simple quick connection of bracing to the beam flanges at the time of general excavation. These braces can be placed at any elevation along the length of the beam. Furthermore, the method allows for changes in brace location during con struction, 4. Insertion of the primary structural framework is facilitated by an innovative combination of double H-beams used as a reaming tool. This tool squares off and evens out the excavation prior to the installation the permanent steel framework,
5. Permits the elimination of reinforcing steel in the unexcavated face of primary elements,
6. Permits the placement of block outs and finished wall surface materials in the element.

The above and other advantages, features and objectives of the invention will become more apparent from the following description taken in conjunction with the accompanying drawings wherein:

BRIEF DESCRIPTION OF THE DRAWINGS

FIG. 8 is a front plan view of a typical connected H-beam pair for forming a primary panel element including block out and showing the foam blocks retained in the outer channels of the connected H-beam pair.

DETAILED DESCRIPTION OF THE INVENTION

As an initial step, the line of cut or of the wall to be formed, is defined by casting a pair of concrete curbs CGC as in Brunner's above-identified British patent, which serves as an initial guide means for excavation devices, which in the embodiments to be described herein are preferably clamshell excavators and, also as aids in aligning and lowering the connected H-beam pair described later herein.

Figure 1:
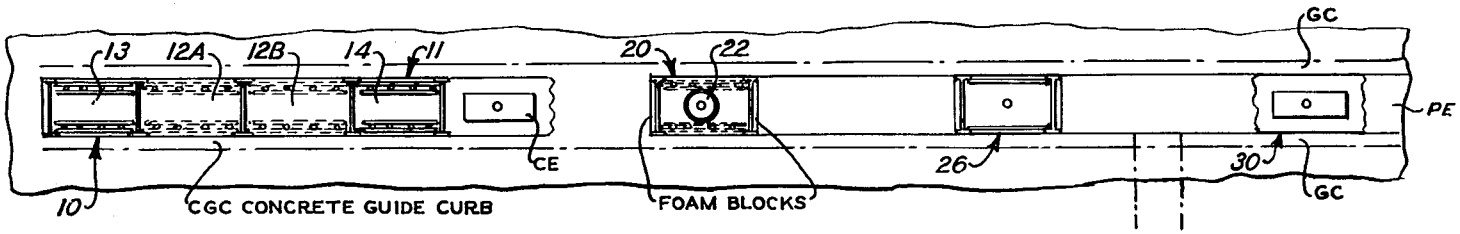
FIG. 1 is a top plan view illustrating a typical plan of excavation sequence along a line of the wall.
Figure 2:
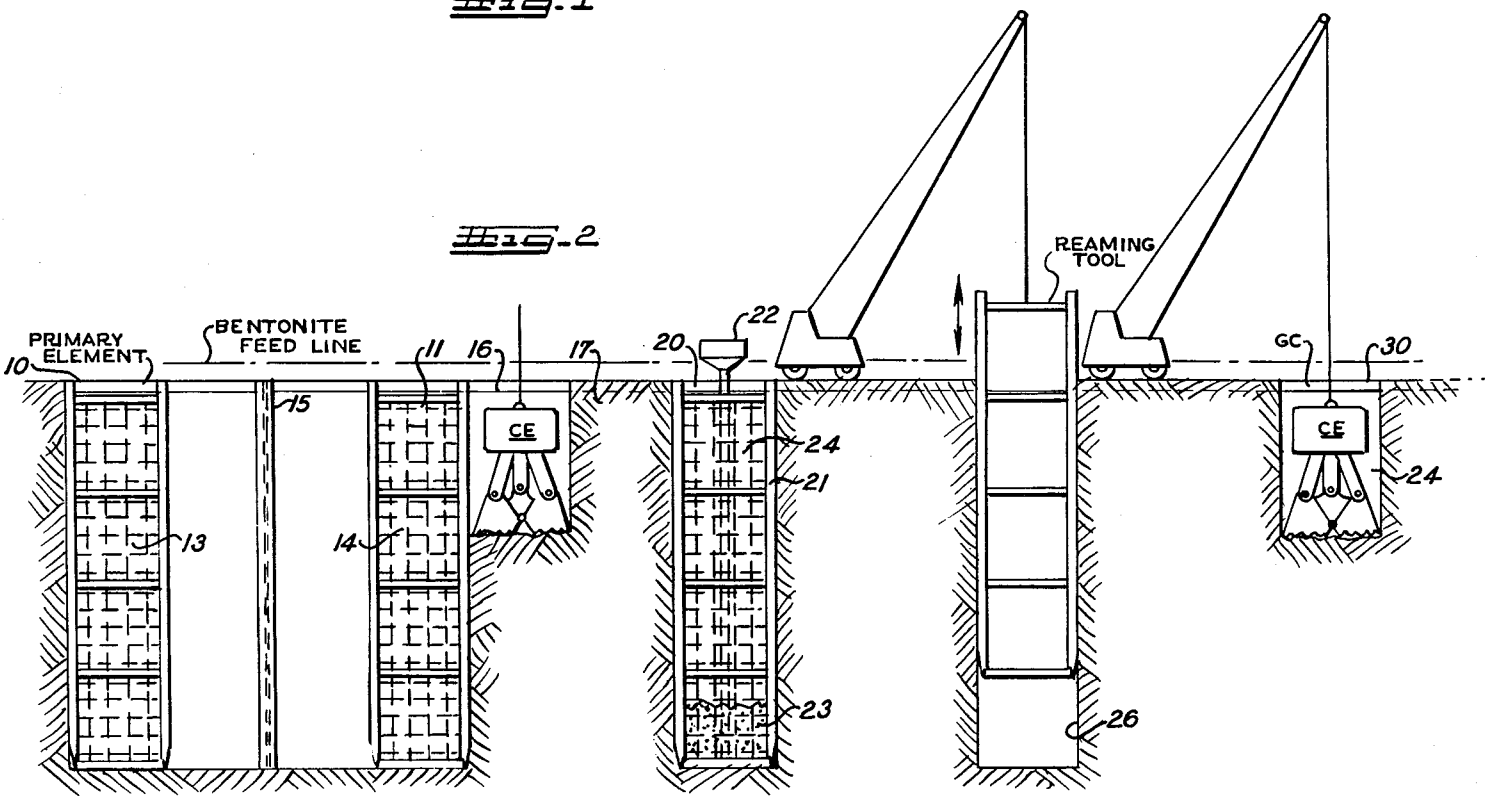
FIG. 2 is a side elevation view illustrating the different phases of the construction in a sequence.

Referring now to FIGS. 1 and 2, the first primary excavation section 10 is excavated using a clamshell excavator (CE) which has an expanse or bite of, for example, ten feet. This first primary elongated trench section 10 is excavated down to the depth D of the wall (which can vary according to bed rock formation, etc.) and as the excavation progresses, a thixotropic colloidal liquid or slurry apt to gel, such as a thickish liquid known in the art as a bentonite slurry or driller's mud, is introduced into the excavation to maintain the walls and prevent collapse thereof during the excavation process, and a bentonite cake formed for waterproofing purposes. A bentonite pond, reservoir or tank (not shown) may be maintained for cleaning the bentonite and reusing same and supplying same via a bentonite line BSL shown diagrammatically in FIG. 2, to the individual excavations as they proceed.

In FIGS. 1 and 2, the first primary excavation 10 is shown as completed and the second excavation 11 has also been completed with connected H-beam pairs 13 and 14 inserted therein and concreted. Primary excavations 10 and 11 are spaced apart a distance greater than the open extent of the excavating tool CE. This permits the excavation of the intervening soil sections 12A and 12B by using the said H-beam channel section as a guide, the opposite side of the clamshell excavator CE being free. As shown the intervening excavation sections 12 are secondary sections and have been designated 12A and 12B, also have an intermediate H-beam 15 inserted therein. These sections are now ready for receipt of a further steel reinforcement cage, as will appear more fully hereinafter. These sections may be filled with a steel fiber reinforced concrete eliminating steel reinforcement cages.

In FIGS. 1 and 2, primary panel section 20 is shown as being in the process of being concreted. Primary panel 20 section has been excavated and reamed and an H-beam rebar pair 21 inserted therein. In addition, the concrete tremie pipe 22 is shown lowered into the excavation and in the process of depositing concrete 23 to displace the bentonite slurry 24. The bentonite slurry may be removed from the panel excavation 20 at the same rate that concrete is introduced through tremie pipe 22. As further illustrated in FIG. 2, the next primary panel section 26 has been excavated by clamshell CE and is in the process of having the side walls and ends thereof reamed by the combination double H-beams which may be strengthened by addition of extra lattice connecting bars and sharpened lower edges for use as a reaming, smoothing and squaring "tool". This reaming tool therefore squares off the ends and evens out the excavation prior to the installation of the permanent H-beam rebar pair. The crane is shown as lowering the H-beam pair which is performing the reaming operation through the action of gravity. It should be appreciated that the H-beam pair may be driven by a power implement instead of simply being raised and lowered by the crane. The debris in the bottom of the reamed excavation is easily removed by the clamshell.

Elongated trench sections are excavated in the manner illustrated to the end of the wall section where the final primary excavation 30 is made. In this instance, the clamshell excavator CE is shown in the initial stages of the excavation and the trench is filled with the slurry 24 and maintained full during the excavation process. In the case of the secondary excavations 16–17, e.g., the excavations intermediate and adjacent a primary excavation, the H-beam channel is used as the guide channel for the clamshell excavator. Foam blocks retained in these channels by temporary angle irons prevent poured concrete which may pass between the flanges of the H-beam and the earth wall from reaching the channel and its surfaces. The clamshell excavator CE in secondary wall section 16 breaks the angles and the foam which is not in the clamshell floats to the surface of the bentonite slurry and is thereafter removed and discarded. If the foam blocks are intact, they may be reused.

CONNECTED H-BEAM PAIRS

The concept of the connected H-beam pair having foam-filled outer channels was invented by the inventor herein and used in a construction project more than a year prior to the filing date hereof as is disclosed in an article entitled "Slurry Wall, Special Equipment Solve "No Room" Excavation Problem", October, 1973 issue of *Roads and Streets* Magazine.

Figure 4:
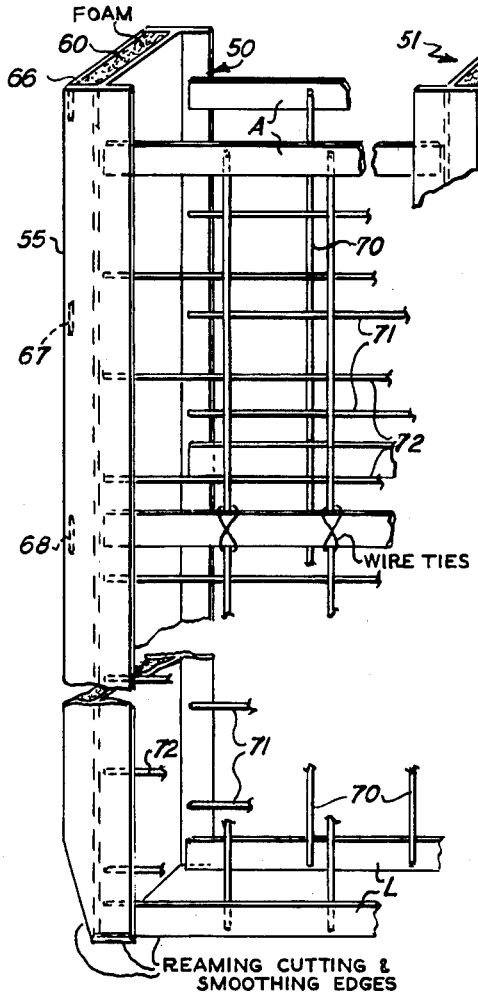
FIG. 4 is an isometric view of the H-beam pair and rebar reinforcements showing the formation of the lower edges of the H-beam pair cutting edges for use as a reaming tool.

In FIG. 4 there is shown a view of a typical connected H-beam pair having foam-filled outer channel; each H-beam pair is constituted by a pair of wide flange H-beams 50 and 51 wherein the flanges of the beams 52, 53 and 54, 55 have their connecting web portions 56, 57, respectively, transverse to the elongated direction of the wall to be formed thereby. The outer or non-facing channel sections of H-beams 50 and 51 are filled with blocks of polystyrene fo am 60 and 61, respectively, which are retained in place by means of steel angles 66 and plates 67. The styrofoam block outs inserted between the flanges of the beams at both ends eliminates the need of pipe joints and other time consuming and expensive construction procedures and most importantly, permits the easy cleaning out of the joint and assures a structurally sound, clean, watertight joint. While I have used the term "H-beams", they could be I-beams or flanged channels as shown in FIG. 4. As illustrated in FIGS. 1 and 2, these polystyrene foam blocks permit the clamshell excavators CE to be guided by the flanges 52, 53 and 54, 55 of the previously cast elongated primary wall sections 10 and 11 of FIG. 2, for example. Thus, in this respect, the invention secures the advantages of the use of a clamshell excavator as is illustrated in the above-mentioned Brunner British patent, the use of H-beam type primary panel (or soldier) constructions, and the bentonite slurry excavation method without any of the significant disadvantages thereof. Thus, there is no need to cast a cementitious fill in and around the soldier H-beams to maintain them in place and then remove the cementitious fill from between the flanges of the H-beam. Moreover, it provides the positive watertight joint that the H-beam type construction provides.

The steel reinforcing structure shown in FIG. 4 is constituted by relatively lightweight vertical bars 70, horizontal bars 71, intermediate weight horizontal bars 72, end horizontal spacer bars 74 and 75. It will be appreciated that the vertical bars 70 and horizontal bars 71 and 72 at each side form a generally rectangular grid of reinforcements and to constitute the cage, end connecting U-shaped elements 74 and 75 are tied to horizontal elements 71 and 72 to the vertical elements 70. This forms an open structure to permit lowering of the tremie pipe 22 to the bottom of the excavation. Furthermore, a lattice system of bars L and angles A is used to rigidly connect the two beams through welding at the ends.

The connected H-beam pair shown in FIG. 1 is being raised and lowered into excavation 26 and has a heavier connecting lattice work and may be provided at the lower edge thereof with earth cutting edges, as mentioned earlier.

After the reaming operation has been completed, any earth or other debris which has been produced at the bottom of the trench is removed by the clamshell excavator CE prior to introducing the connected H-beam pair which will form a permanent part of the installation. As indicated earlier, the reaming tool per se will be used in each individual excavation and will be utilized as the permanent part of the installation in the last wall panel section to be formed.

STEEL FIBER REINFORCED CONCRETE WALLS

Instead of using reinforcing cages in excavation section 11, the two end H-beams 80 and 81 in combination with the intermediate H-beam 15 may be used to form a steel fiber reinforced concrete wall and no rebar or steel reinforcement cage is utilized. In this instance, steel fiber reinforced concrete is introduced into the excavation by way of tremie pipe 22. This steel fiber reinforced concrete is available from Ribbon Technology Corporation and described in that company's Bulletin No. SSB-101, January, 1974 and Bulletin No. SSB-102, (undated).

Figure 3:
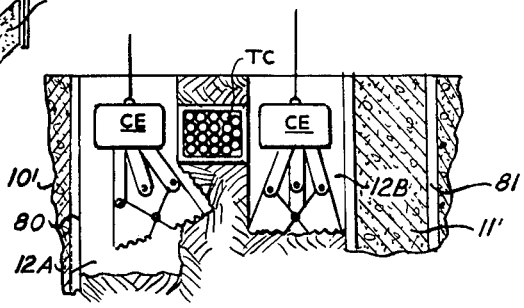
FIG. 3 illustrates an excavation sequence carried out about an underground obstruction such as a twenty-four inch telephone conduit.

There are instances where there are underground obstructions such as utilities, telephone lines, etc. which are in normal excavation temporarily relocated to permit the formation of an uninterrupted reinforced concrete wall underground. Such an obstruction is shown in FIG. 3 as a telephone conduit which may be four feet square. In this case, the panel sections 13' and 14' in excavations 10' and 11' are formed to each side of the panel section to be excavated which would encompass the telephone conduit TC. The plan of the excavation is designed so that H-beam 80 is positioned the length approximately of one trench section which can be excavated by the clamshell excavator CE. In this case, with a clamshell CE of seven feet, H-beam 80' is positioned to be slightly greater than seven feet from the left vertical wall section of telephone conduit tile TC. The preliminary excavation PE to the left of telephone conduit TC is excavated using the foam-filled or loaded channel of H-beam 80 as the guide therefor. In like manner, the excavation 11' is excavated using the foam-filled or loaded channel of H-beam channel 81 as the guide therefor. Then the clamshell excavator is lowered down into the trench a distance D below the level of the telephone conduit TC and then the cable and support system for the clamshell excavator CE is translated in the direction toward the telephone conduit TC. A portion then of the earth is excavated in this fashion and is indicated by the dotted line. A bite of earth is removed which permits the clamshell excavator to then be positioned for a vertical excavation below the telephone conduit TC. A similar excavation of the left half of the earth column below the telephone conduit TC is performed in the excavation to the left of the telephone conduit. This excavation is carried out so as to remove the column of earth from beneath the telephone conduit TC and to clean the conduit free of earth. Then after this excavation is completed, the bentonite which is maintaining the excavation walls is displaced by the introduction of the steel fiber reinforced concrete. The steel fiber reinforced concrete then, in combination with the H-beams 80 and 81 forms a reinforced concrete wall which has the strength approaching that of the rebar cage reinforced steel concrete wall.

1973 TEST INSTALLATION IN WASHINGTON, D.C.

In this installation, the H-beams were 80 feet long having $10\frac{1}{2} \times 1$ inch flanges and $28\frac{1}{4} \times \frac{5}{8}$ inch web. The outward ends of the H-beams of the channels were filled with blocks of polystyrene foam held in place by steel angles and bars. At a location where there were no large adjacent loads, such as buildings, etc., the assignee hereof tested the construction of a double intermediate wall panel section as illustrated at 12A and 12B in FIG.

2. The results demonstrated that while the secondary element span between primary elements was double the span between H-beams in a primary element, the work was safely able to proceed at a relatively highly accellerated rate. The foam-filled channels of two spaced primary elements (such as 10 and 11 of FIG. 2) permitted easy two-step excavation process to be carried out without any significant drifting of the intermediate element from vertical. There was no noticeable subsidence of neighboring street (the test was not permitted to be carried out adjacent any buildings by the owner's Engineer).

SPECIAL PANEL SECTIONS

As indicated earlier, the interior walls may be exposed by later excavations, e.g. subways, basement walls, etc. Decorative and other architectural effects can be easily achieved according to the invention.

Figure 7:
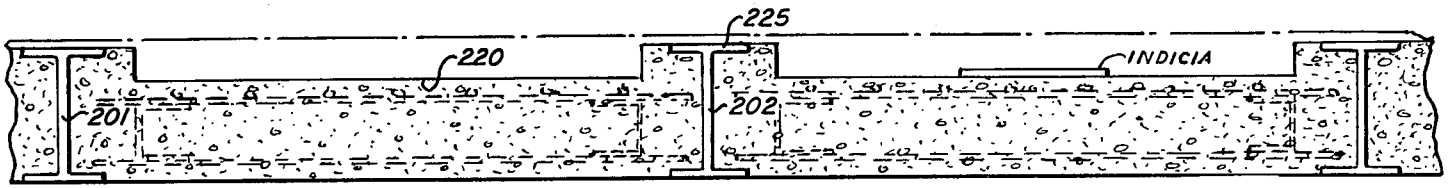
FIG. 7 is a top plan view showing the final cross-sectional view of a wall constructed using the block out technique of the invention.

FIGS. 7 and 8 show a method of providing block outs and finished interior surfaces on a slurry wall. The procedure is to install as a unit two beams 201, 202, reinforcing steel cage 203, and a block out device 204 which could consist of plywood, or some other easily removed material. In this embodiment, two layers of three-quarter inch plywood 206 and 207 and 2 × 4 spacers 208–212. This block out 204 permits the construction of an 18 inch thick wall in a 24 inch wide slurry excavation. As general excavation of the subway proceeds from straight level downwards, the excavating contractor would remove the plywood form and expose a smooth face interior concrete surface for use as a subway wall as shown in FIG. 7. Thus, the surface or face 220 of each wall section is a formed surface.

As is well known, a reinforcing bar in concrete has to have a certain amount of concrete cover on it to have the reinforcing work and this is a spacer to keep the reinforcing cage clear of the face of the form. Spacers such as horizontally placed pipe 215 keep the reinforcing properly spaced from the concrete surface. This keeps the reinforcing the minimum cover distance from the face of the concrete. While I have shown pipe spacers 215, the spacers can be pieces of bent wire scrap; all they are required to do is keep the rebar cage and the plywood form at a specified distance. Moreover, instead of being smooth faced, the block out can be textured or carry a device or inserts or engraved indicia, such as a subway station sign, or other decorative art work.

Figure 6:
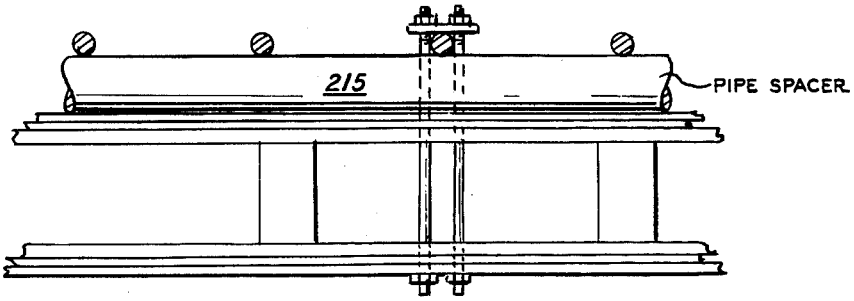
FIG. 6 is a partial top sectional view of a block out spacer and reinforcing steel.
Figure 5:
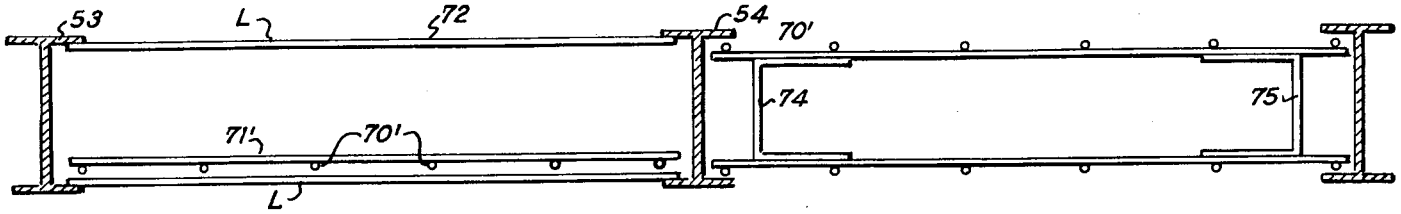
FIG. 5 is a top plan view of a concreted wall section made using alternated single (primary panel) and double (secondary panel) reinforcing rods.
Figure 6:
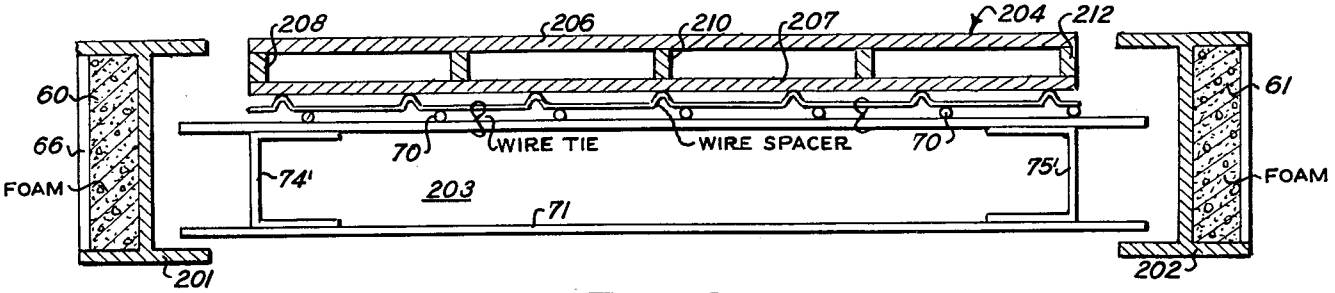

It should be noted that in FIG. 6, the plywood outer face is parallel to the outer flange surfaces and the H-beams have Styrofoam on the outside channel faces. Another feature of the invention is that with a 24 inch wide clamshell you can build an 18 or 12 inch thick wall or smaller size if desired.

In certain locations the right of way of the subway or railroad is so narrow that they do not have sufficient room between the subway line of the structure and the property line to build a 24 inch wall. This invention provides a means of using a 24 inch wall in a 12 inch space; the 24 inch wall is constructed, using block outs as described above and subsequently the 12 inch portion of the H-beam can be cut away by a torch; you don't have to demolish concrete or do any other work on the inside. If it was desired to build a permanent structure inside section 225 of the beam will interfere partially with the permanent structure. So according to the invention, the contractor would build part of the permanent structure and then with a torch, for example, remove 6 inches of beam that is no longer necessary for the support of the wall and discard it. Thus, this cut away beam portion is only the temporary earth support system for the subway. In New York and Washington the slurry walls (described later herein) were used as a temporary construction. The slurry wall was a temporary earth retention system so that there would be a completely independent structure built within the two slurry walls on either side of the street and that structure will receive the final loading of the soil.

Referring again to FIGS. 1 and 2, showing the primary panel; the primary panel in this particular construction is excavated with an 11 foot (for example) long clamshell CE which excavates a slot which would permit the installation of a cage having H-beams 10 feet center to center of web and the flanges just touching the extreme limits of the excavation, so this will be the limit of the first excavation. At the conclusion, or once the excavation is carried to sub-grade elevation or bottom of wall elevation, a primary panel cage is installed and that cage consists of two standard rolled wide flange beams tied together with batten plates or lattice work and a mesh of reinforcing steel which in this example are No. 7's ($\frac{7}{8}$ inch diameter) horizontal and No. 5's ($\frac{5}{8}$ inch diameter) vertical. The only reinforcing that is necessary in this wall is the No. 7's or the $\frac{7}{8}$ inch diameter bars which carry the load of the soil to the two beams. This is a concrete beam which spans horizontally from H-beam to H-beam and the reinforcing that is necessary is the No. 7 bar. Any other steel, including the vertical, is only necessary to space the cage in the panel.

This construction eliminates all of the back steel and all of the spacer bars that are used in a typical secondary panel as an example. This can save, for example, 3 pounds of steel per square foot which dollarwise is probably in the order of a dollar a square foot, which is a significent saving of about 3–5% of the cost of the wall for only on the primary panels. It is further minimized because the wall is constituted by one third primary panels and two thirds secondary panels (in the construction just described), e.g., one primary panel for every two secondary panels. With respect to the two secondaries, there is one H-beam between the secondaries which is installed independent of the reinforcing cages. If a series of ten foot primary panel sections and ten foot secondary panel section are done, you have to have two different size clamshells to do the job: a clamshell 11 foot long is needed to do the primary panel and a clamshell 9 foot long is needed to do the secondary to fit between the beams. Now with a single primary panel section and a double secondary, you can use the 11 foot clamshell to do the primary panel and the secondary panel which is in this case 20 feet long. Now once you have brought a 20 foot panel down to bottom of wall elevation, you install a cage consisting of a mesh of steel on the inside face, a mesh of steel on the outside face and all of the special spacer bars necessary to keep those two faces of steel in their proper location in the panel. Then install a single wide flange beam at midpoint of the panel and between the single wide flange beam 15 and a previously placed beam (80 or 81) which is 10 feet away and then install the second cage. The two 10 foot secondary panels are ready to receive concrete. This is done by installing two tremie pipes, one in each secondary panel section and you cast concrete simultaneously through the two tremie pipes so that you do not have a differential in pressure on the free beam to either kick it this way or that.

In the construction of the block out type wall, it is important to take into consideration the bentonite slurry and concrete loading effects on the block out device. The block out device must not affect the positioning of the rebar cage — block out assembly. Thus bouyancy in the block out device is lowered by maintaining both ends BE open. This permits the space between the two plywood sheets to fill with the liquid in the trench. This is particularly important when the rebar cage block out device is inserted in secondary excavations without the connected H-beam pair. If the block out device were hollow, light weight and sealed, the bouyancy thereof could cause the rebar cage to be poorly positioned or aligned in the excavation. Another advantage of the open ended construction of the block out device is that it tends to avoid buckling and distortion thereof and shifting of the rebar cage — block out assembly during the pouring of the concrete. A sixty foot depth (column) of concrete which, exemplarily, weighs 150 pounds per cubic foot, is a large load on the plywood sheets and thus is offset somewhat by permitting the block out to fill with bentonite slurry so the differential loading is significantly less. While a small amount of concrete may enter the space between 2 × 4 spacers, the space remains predominantly filled with bentonite slurry.

While solid block outs may be used, it should be appreciated that they can be more expensive and, in the end more difficult to separate from the concrete after the excavation in the case of a subway wall.

The connected beam pair shown in FIG. 4 can be used to reduce the amount of steel in the wall and may be used to position the reinforcement near the unexcavated face of an excavation or, more aptly, the tensile force side of the wall, to thereby reduce the amount of reinforcement steel in a wall.

While the preferred embodiment guide curb GC is positioned along the line of the wall, as described in Brunner's British Pat. No. 913,527, it will be appreciated that other forms of guide curbs may be used, and in other embodiments such guide curb need not be used. A rail line carrying the excavating equipment may be used to define the "line of cut", the wall being located a fixed distance from the rails.

Moreover, instead of conventional steel reinforcing cages, post-tension walls can be constructed in essentially the same manner, the essential difference being that a draped post-tensioning tendon assembly is substituted for the reinforcing steel cages. It will also be appreciated that various forms of bracing, tie-backs, keys, dowels, or sleeves may be installed with the steel reinforcing cage.

What is claimed is:

1. For use in constructing a vertical concrete underground panel wall section by the slurry trench excavation method, a reinforcement cage assembly, a pair of spaced flanged steel beams, each beam having a length at least equal to the depth of said panel wall section and a web portion substantially equal to the width of an elongated excavation for said panel wall section, the web portions of each said flanged beam being substantially parallel, means securing said cage in interfitting relation to said flange surfaces, respectively, the improvement comprising block out means removably secured in spaced relation to said steel reinforcing cage, said block out means having a flat surface which is coplanar with flanges on both said pair of beams and said block out is constructed to have low bouyancy such that when immersed in slurry and/or concrete said block out means does not affect the positioning or alignment of said flanged beams and reinforcement cage.

2. The invention defined in claim 1 wherein said flanged beams are steel H-beams and said block out means has a second surface opposite said flat surface coplanar with the flanges of said pair of beams, and substantially coextensive with the area thereof, said second surface constituting a concrete mold surface for surface shaping concrete.

3. The invention defined in claim 1 wherein said reinforcement cage assembly is a single grid of horizontal steel bars and is positioned in coplanar spaced relation to said flat surface of said block out means.

* * * * *

UNITED STATES PATENT AND TRADEMARK OFFICE

CERTIFICATE OF CORRECTION

PATENT NO. : 4,055,927

DATED : November 1, 1977

INVENTOR(S) : George John Tamaro

It is certified that error appears in the above-identified patent and that said Letters Patent are hereby corrected as shown below:

Assignee should read "ICOS Corporation of America"

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*